US008517640B2

(12) United States Patent
Kasprick et al.

(10) Patent No.: US 8,517,640 B2
(45) Date of Patent: Aug. 27, 2013

(54) METHOD AND APPARATUS FOR LOAD TESTING A PILE

(75) Inventors: Ben Kasprick, Sherwood Park (CA); Thomas D. Bradka, Sherwood Park (CA); Denton A. Kort, Gainesville, FL (US)

(73) Assignees: Loadtest, Inc., Gainesville, FL (US); Helical Pier Systems Ltd., Fort Saskatchewan, AB (CA)

( * ) Notice: Subject to any disclaimer, the term of this patent is extended or adjusted under 35 U.S.C. 154(b) by 0 days.

(21) Appl. No.: 13/032,097

(22) Filed: Feb. 22, 2011

(65) Prior Publication Data

US 2011/0217125 A1 Sep. 8, 2011

Related U.S. Application Data

(60) Provisional application No. 61/306,681, filed on Feb. 22, 2010.

(51) Int. Cl.
*E02D 5/08* (2006.01)

(52) U.S. Cl.
USPC ..... 405/251

(58) Field of Classification Search
USPC ..... 405/253, 252.1, 251, 232, 242
See application file for complete search history.

(56) References Cited

U.S. PATENT DOCUMENTS

| | | | | |
|---|---|---|---|---|
| 4,845,996 | A * | 7/1989 | Bermingham | 73/807 |
| 5,282,701 | A * | 2/1994 | An et al. | 405/245 |
| 5,576,494 | A * | 11/1996 | Osterberg | 73/784 |
| 5,608,169 | A * | 3/1997 | Fujioka et al. | 73/803 |
| 6,029,526 | A * | 2/2000 | Feldman et al. | 73/803 |
| 6,814,525 | B1 * | 11/2004 | Whitsett | 405/233 |
| 7,353,714 | B2 * | 4/2008 | England et al. | 73/784 |
| 2006/0233617 | A1 * | 10/2006 | Shotton et al. | 405/232 |
| 2008/0101873 | A1 * | 5/2008 | Fox et al. | 405/239 |
| 2008/0141781 | A1 * | 6/2008 | Hayes | 73/788 |
| 2011/0002744 | A1 * | 1/2011 | Tadros et al. | 405/232 |

* cited by examiner

*Primary Examiner* — Thomas B Will
*Assistant Examiner* — Patrick Lambe
(74) *Attorney, Agent, or Firm* — Saliwanchik, Lloyd & Eisenschenk

(57) ABSTRACT

Embodiments pertain to a bi-directional testing method and apparatus for use with a pile. One embodiment utilizes a helical pile central shaft divided into two sections. An expandable bi-directional testing apparatus that includes a sacrificial hydraulic jack, such as, for example, an Osterberg Cell®, that can be installed within the central shaft between the two sections. One or more tell tale rods can be attached to the bi-directional testing apparatus. During testing, expansion of the Osterberg Cell® causes the bi-directional testing apparatus to expand, which can result in movement of the one or more tell tale rods. The movement of the tell tale rods can be correlated to the force exerted by the Osterberg Cell® and provide information regarding the status load bearing capacity of the helical pile.

28 Claims, 10 Drawing Sheets

Parts:
A—Pile pipe 8 5/8" -36"
B—Lock plate
C—Gear connection push plates
D—Drive gear
E—Plug weld holes

METHOD AND APPARATUS FOR LOAD TESTING A PILE

CROSS-REFERENCE TO RELATED APPLICATION

The present application claims the benefit of U.S. Provisional patent application No. 60/306,681, filed Feb. 22, 2010, which is hereby incorporated by reference herein in its entirety, including any figures, tables, or drawings.

BACKGROUND OF INVENTION

Helical piles, also known as screw piles or screw anchors, are structural, deep foundation elements used to provide stability against forces exerted by axial compression, tension and/or lateral loading (Bradka, 1997). Typical helical piles utilize one or more helical screw plates affixed around one end, the toe end, of a continuous central shaft of smaller diameter with a connection plate at the opposite or top end. Multiple helices used on the toe end of a central shaft can be of equal diameters or have a smaller diameter towards the pile bottom. Helical piles are usually, but not exclusively, fabricated from steel that can also be galvanized for extra protection against corrosion. Helices are attached to the shaft generally by welding, but may also be bolted, riveted, or monolithically made with the shaft (Bradka 1997).

In use, a helical pile is, basically, screwed into the soil, such that the helical plate engages with the soil to distribute the axial load. As a result, there is minimal or no vibration associated with the installation of helical piles, unlike most driven piles. Further, the helices are configured for soil displacement rather than soil excavation, so there is little or no spoil to be removed, eliminating the potential issue of contaminated soils being brought to the surface. This method also engenders tensile strength to screw pile.

Once a helical pile has been placed, it is usually standard practice to test the static load-bearing capacity before beginning other related construction. Conventional "top down" load testing is the most common method of predicting the axial load capacity of helical piles. With this method, a hydraulic jack is positioned against the top end of the pile and works against a loading frame constructed of heavy beams and reaction piles. By observing the top end of the pile, the load vs. deformation behaviors can be recorded during the test and used to predict the capacity of the helical pile. However, this testing method is dangerous, expensive, and can be inaccurate.

About 25 years ago, Dr. Jorj Osterberg developed an innovative, relatively low-cost, alternative static load testing method, referred to as the Osterberg Cell® or O-Cell® for short (Osterberg, 1998). The O-Cell® is a bi-directional static load testing device useful with drilled shafts, bored piles, caissons, driven piles, slurry walls, barrettes, continuous flight auger (CFA) piles, or other similarly constructed pile foundations. The O-Cell test operates by the separation and observation of the shaft and toe behavior, as well as other results important for assessing the adequacy of the pile (Fellenius, 2001). In the conventional bi-directional load test, a sacrificial O-Cell™ (hydraulic jack) is placed during construction of the pile at or near the bottom of the pile. When the pile construction is complete, the previously positioned O-Cell® can be utilized to separate and test the pile loading capacity. During the O-Cell® test, load increments are applied to the pile by means of incrementally increasing the hydraulic pressure in the O-Cell®, which causes it to expand in a jack-like fashion, pushing the pile shaft upward and the pile toe downward (Fellenius, 2001).

Unfortunately, because of the continuous central shaft, necessary to withstand the higher torque required for turning helical piles into the soil, bi-directional technology, such as the O-Cell®, has not been incorporated with helical piles. Thus, "top down" load testing has been the method used for predicting the axial load capacity of screw piles.

BRIEF SUMMARY

The embodiments of the subject invention are directed to an improved helical pile system and method for load testing a helical pile. Embodiments of a helical pile system in accordance with the subject invention incorporate bi-directional testing technology for conducting static load testing.

In one embodiment, the central shaft of a helical pile is divided into two sections and a bi-directional testing device is positioned between the two sections such that the shaft sections can be separated along the axial axis of the shaft during bi-directional testing. According to one embodiment of the invention, the central shaft of a helical pile is divided into three or more interlocking, separable sections. Positioned within the central shaft and between and affixed to each interlocking section is a bi-directional assembly, which includes an expandable jack-like apparatus, such as, for example, an O-Cell®, or like device, positioned therein. As the bi-directional assembly expands, the interlocking sections of the central shaft, attached thereto, separate.

The axial load bearing capacity of a helical pile is directly dependent upon the strength of the surrounding soil. In particular, the load bearing capacity is the summation of individual resistances of the helical plate(s) and friction along the central shaft attributable to the surrounding soil. More specific embodiments can include configurations to specifically test the toe and/or shaft resistance of a helical pile. The observation of "tell tale" indicators attached to the shaft and/or the toe, the amount of force required to expand the bi-directional assembly, soil characteristics, and other known factors can be used to calculate the ultimate screw pile capacity.

Specific embodiments involve injecting a fluid, such as hydraulic fluid, into a cell, having a top plate and a bottom plate, in order to create a force that pushes up on the top plate and pushes down on the bottom plate. The top plate then pushes up on the distal end of a section of the shaft above the tip plate, e.g., a connecting shaft section, and the bottom plate pushes down on a section of the shaft below the bottom plate, e.g., a toe shaft section. The top plate and bottom late can have a variety of shapes and designs and can interconnect with the connecting shaft section and toe shaft section, respectively, in a variety of manners so long as the force is transferred.

As used herein, and unless otherwise specifically stated, the terms "operable communication" and "operably connected" mean that the particular elements are connected in such a way that they cooperate to achieve their intended function or functions. The "connection" may be direct, or indirect, physical, or remote.

Further, reference is made throughout the application to the "proximal end" and "distal end." As used herein, the proximal end 200 is that end nearest to or above the graded elevation 100 or soil surface. Conversely, the distal end 300 of the device is that end furthest from the proximal end intended to be placed deepest within the soil.

As used in the specification and in the claims, the singular for "a," "an" and "the" include plural referents unless the context clearly dictates otherwise.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. It should also be understood that the drawings presented herein may not be drawn to scale and that any reference to dimensions in the drawings or the following description are specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIG. 11A shows an exploded view of the assembly prior to installation within a central shaft and FIG. 11B shows the assembly after installation.

DETAILED DISCLOSURE

Embodiments of the subject invention are directed to an improved helical pile system and method for load testing a helical pile. Embodiments of a helical pile system, or similar system, incorporate bi-directional load testing technology for conducting static load testing.

Figure 2A:
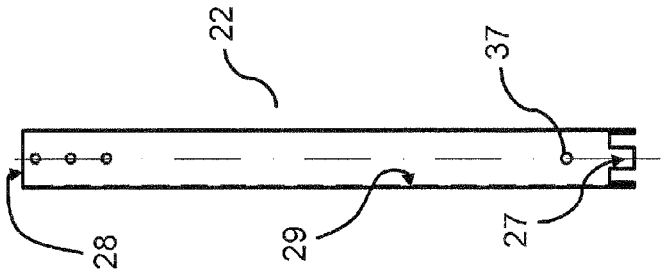
FIGS. 2A and 2B illustrate the embodiment shown in FIG. 1, having a divided central shaft having a connecting shaft (FIG. 2A) section and a toe section (FIG. 2B). This embodiment utilizes a single helical plate, wherein the interdigitating profiles of the two sections is formed with interlocking teeth.
Figure 2B:
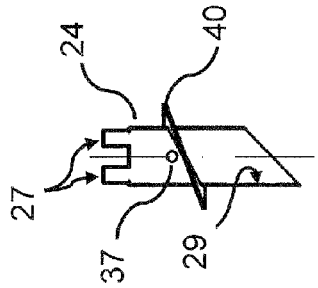
Figure 1:
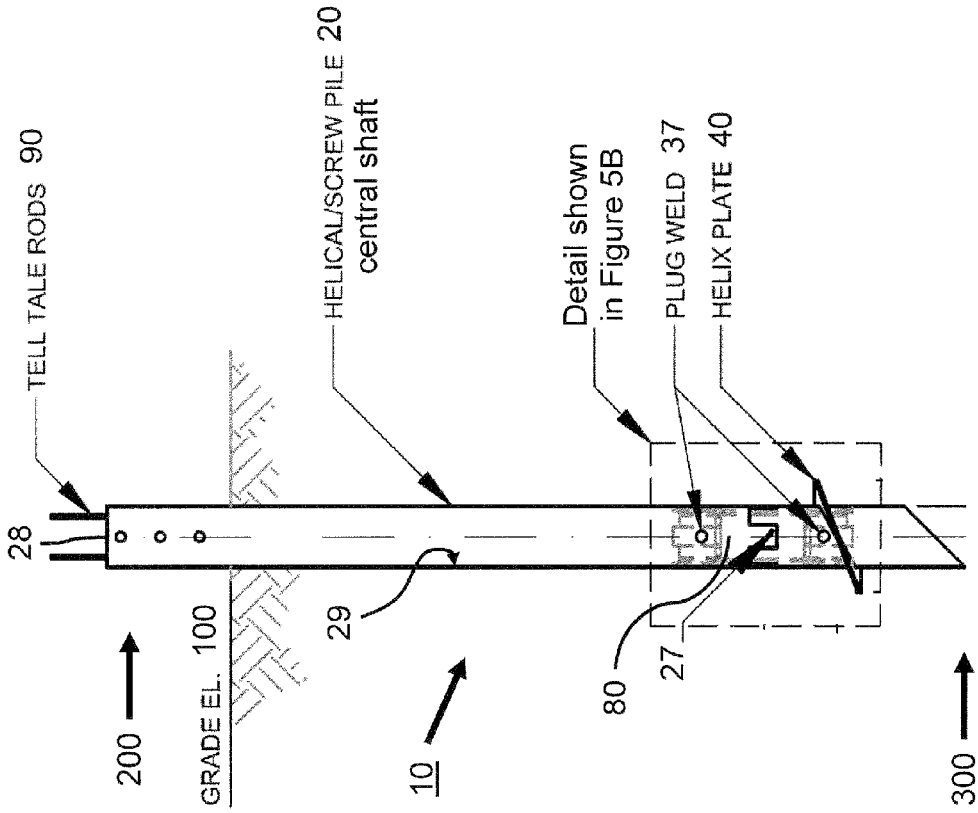
FIG. 1 is an illustration of one embodiment of a helical pile according to the subject invention, wherein all of the components are assembled and positioned within a soil profile. This embodiment utilizes a single helical plate. The internally bi-directional assembly is shown within the dotted line box.
Figure 4A:
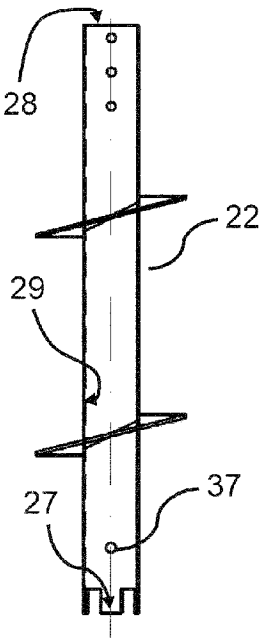
FIGS. 4A and 4B illustrate the embodiment of FIG. 3, having a divided central shaft having a connecting shaft (FIG. 4A) section and a toe section (FIG. 4B). This embodiment utilizes multiple helical plates, wherein the interdigitating profiles of the two sections is formed with interlocking teeth.
Figure 4B:
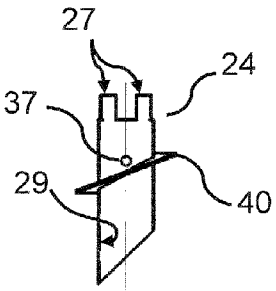
Figure 3:
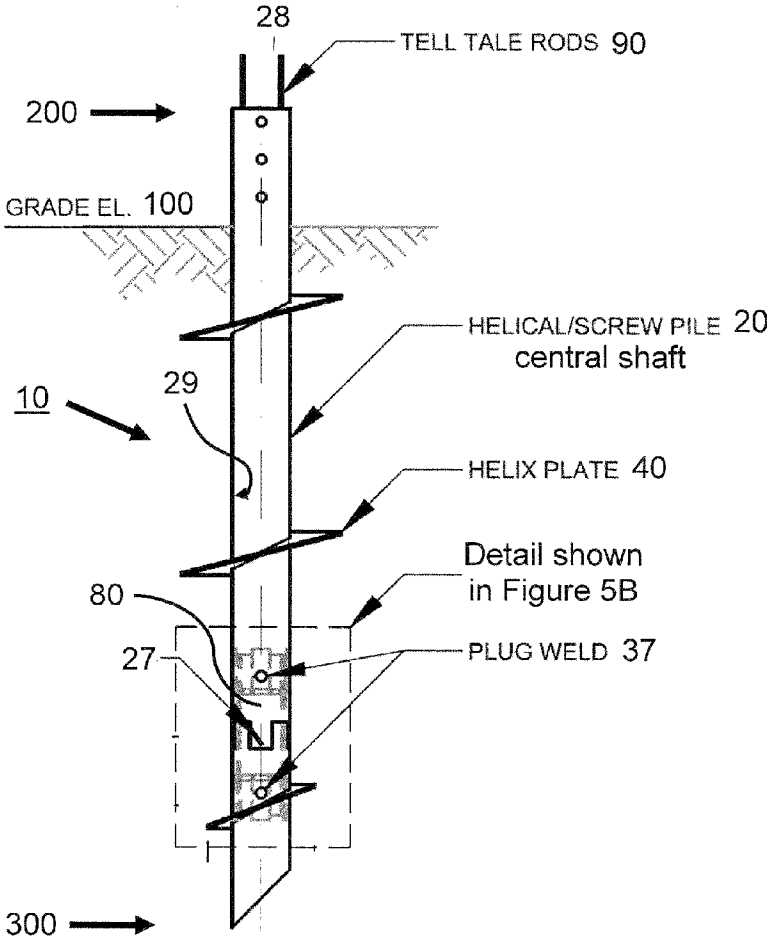
FIG. 3 is an illustration of an alternative embodiment of a helical pile according to the subject invention, wherein all of the components are assembled and positioned within a soil profile. This embodiment utilizes multiple helical plates attached to the connecting shaft and toes sections. The internally bi-directional assembly is shown within the dotted line box.
Figure 5A:
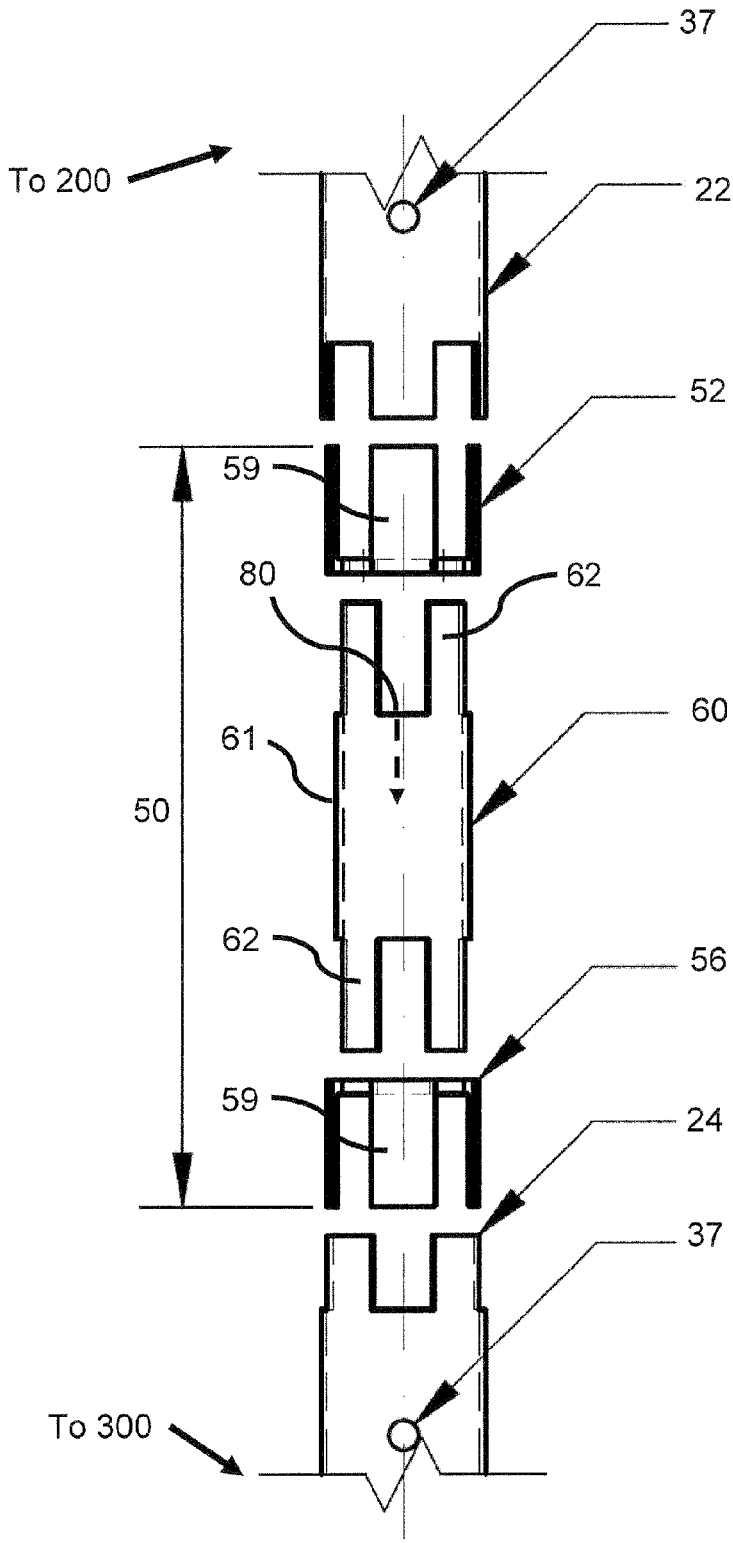
FIG. 5A is an exploded view of one embodiment of a bi-directional assembly prior to installation within a central shaft.
Figure 5B:
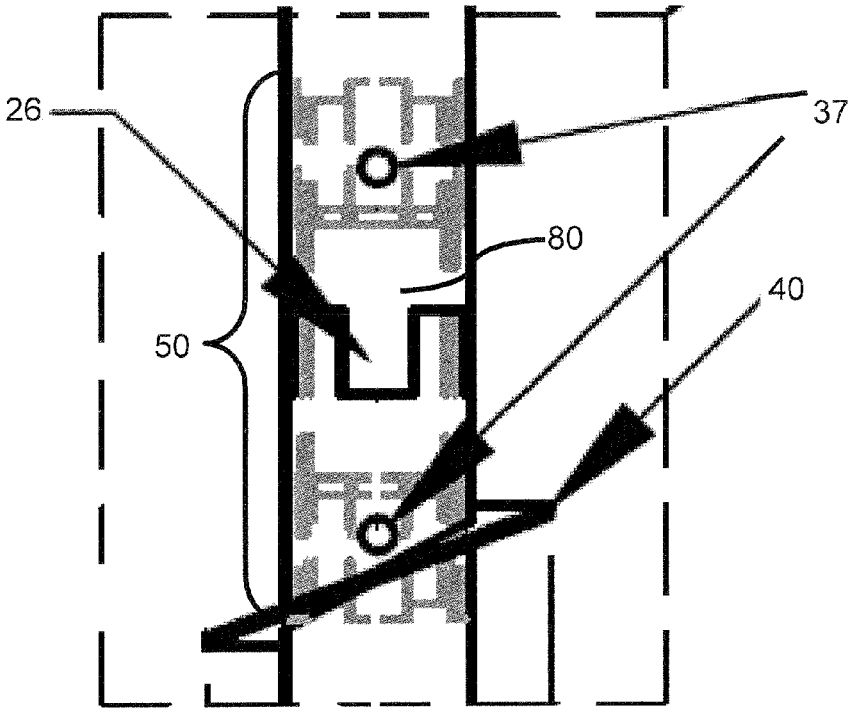
FIG. 5B is an enlarged side view of one embodiment of the bi-directional assembly, as shown in FIG. 1.

With reference to the attached figures, which show certain embodiments of the subject invention, it can be seen that a helical pile 10 can have a hollow or partially hollow elongate central shaft 20. The central shaft can be divided into at least two sections, a proximal connecting shaft 22 and a distal toe 24. One or more helical plates 40 can be affixed to the connecting shaft and/or toe. FIGS. 1, 2A and 2B illustrate an embodiment of a helical pile having a single helical plate 40 affixed to the toe 24. FIGS. 3, 4A and 4B illustrate an embodiment of a helical pile 10 having multiple helical plates 40 affixed to the connecting shaft 22, as well as the toe 24. Within the central shaft and operably attached between the connecting, or top, shaft and the toe is a bi-directional assembly 50 that includes a top bearing 52, bottom bearing 56 (collectively referred to as "bearings") and center assembly 60 that together form an adjustable chamber 80 that can contain a bi-directional testing apparatus (not shown). FIGS. 5A and 5B illustrate a bi-directional assembly 50 in accordance with specific embodiments of the subject invention, while FIGS. 6-8B illustrate additional embodiments of a bi-directional assembly 50.

An embodiment of a helical pile 10 can be bored into the soil. The central shaft 20 can be used to turn one or more helical plates 40 attached thereto, which engage with the soil. Other shaped plates or other forms or extension structures can be used and can extend from the central shaft such that rotating the central shaft in a driving direction while the extension structures are engaged with the soil causes the soil to push down on the pile so as to drive the pile further into the soil. The number and size of helical plates, or helices, affixed to the central shaft can depend upon the expected soil profile. For example, deep, firm clay soil profiles can allow two to three helical plates of relatively large diameter to stabilize the helical pile. Usually the central shaft is turned by a high torque producing motor, such as, for example, a hydraulic drive motor. The torque applied to the helical pile is transferred to the surrounding soil partly through the central shaft and partly through the one or more helices. The amount of torque necessary to screw a helical pile into the ground is dependent upon several factors, not the least of which is, again, the soil profile.

The central shaft 20 of one embodiment of the subject invention is separated into at least two sections, those being a connecting shaft 22 and a toe 24, such as shown, for example, in FIGS. 2A and 2B or 4A and 4B. Other embodiments can separate the central shaft into three or more sections. In one embodiment, the connecting shaft 22 is an elongated pipe and is hollow or at least partially hollow. In a particular embodiment, the length of the connecting shaft is significantly greater than the length of the toe 24 section. However, in alternative embodiments, the toe and connecting shaft could be equivalent or almost equivalent in length. Thus, the length of the connecting shaft can vary depending upon a variety of factors. Further, the diameter of a central shaft and toes can also vary. In one embodiment, the diameter of the central shaft and toe are different. In a specific embodiment, the diameters of the central shaft and toe are generally the same. A person with skill in the art would be able to determine an appropriate length, diameter, thickness, and other dimensions for a connecting shaft. Any and all such variations are considered to be within the scope of the subject invention.

In addition to the dimensions of the central shaft 20, the materials utilized for the central shaft can also be of considerable importance. Helical piles are usually intended to be in place for many years or even decades. Thus, it is important that the materials utilized be capable of maintaining structural integrity for prolonged periods of time. Some of the first piles ever installed around the Thames River were manufactured from cast iron and lasted for over 150 years. There are numerous factors that can dictate the type of material utilized, including, but not limited to the required length of the central shaft, the soil profile in which it is to be used, environmental conditions, geographic location, size and number of helical plates attached thereto, expected load, as well as other factors known to those with skill in the art. In an embodiment, high tensile 350 to 400 grade steel can be used for the central shaft and toe sections. In a particular embodiment of the subject invention, galvanized ASTM A53 steel pipe is utilized for the connecting shaft and toe sections. However, it should be understood that the selection of appropriate alternative materials is within the competence of those skilled in the art, as is the determination of appropriate dimensions of a central shaft for a specific use. Any and all such variations are considered to be within the scope of the subject invention.

In a further embodiment, the toe section 24 has a proximal end that is operably attached to the distal end of the connecting shaft. This allows the distal end of the toe to function as the "point of attack" during the soil penetration process. In one embodiment, the toe is a hollow or at least partially hollow pipe. In a further embodiment, the toe is hollow or at least partially hollow from the proximal end to the distal end. As will be disclosed, this allows access to attach the bottom bearing 56 and/or one or more tell tale rods within the toe section, if desired. In a further embodiment, the toe section is significantly shorter than the connecting shaft, as shown, by way of example, in FIGS. 2B and 4B. However, as mentioned previously, the length, as well as the diameter, of the toe section can certainly vary depending upon any of a variety of factors known to those with skill in the art. Such variations are considered to be within the scope of the subject invention.

In addition, to facilitate penetration of the soil, any of a diversity of "bit" types known to those with skill in the art can be operably attached to the distal end of the toe. In an alternatively embodiment, the distal end of the toe is configured or formed into a shape able to expedite soil penetration as the pile is turned.

The operable connection between the distal end of the connecting shaft 22 and the proximal end of the toe 24 can be realized by a variety of methods and techniques. As will be discussed in further embodiments herein, a bi-directional assembly 50 can be positioned within the central shaft 20, typically spanning the juncture of the connecting shaft and the toe. As the name implies, the bi-directional assembly can be used to simultaneously apply force upward against the connecting shaft and downward against the toe. Specific embodiments involve injecting a fluid, such as hydraulic fluid, into a cell, having a top plate and a bottom plate, in order to create a force that pushes up on the top plate and pushes down on the bottom plate. The top plate then pushes up on the distal end of a section of the shaft above the tip plate, e.g., a connecting shaft section, and the bottom plate pushes down on a section of the shaft below the bottom plate, e.g., a toe shaft section. The top plate and bottom late can have a variety of shapes and designs and can interconnect with the connecting shaft section and toe shaft section, respectively, in a variety of manners so long as the force is transferred.

During the testing process, the connecting shaft and the toe can move away from each other. In a specific embodiment, the force tending to move the connecting shaft and toe away from each other is increased until the toe and/or the connecting shaft start to move and then the force is no longer increase so that actual movement of the connecting shaft and/or toe is minimal. The separation force(s), amount of movement of the connecting shaft, and amount of movement of the toe can be measured and utilized, along with other information, to determine the overall load bearing capacity of the helical pile. In an embodiment, the operable connection between the connecting shaft and the toe to be at least partially separable, but also permit realignment, once the testing process is complete.

A further consideration with regard to the operable connection between the connecting shaft and the toe is the placement process for the helical pile. As mentioned above, helical piles are typically screwed into the soil by the application of rotational forces, or torque, and/or axial downward forces, and with the optional assistance of the one or more helices or other extension structures. In an embodiment, the operable connection between the connecting shaft and toe can withstand the forces, such as, for example, torque, friction, axial force, etc, that the helical pile can experience during the placement process.

In one embodiment, the distal end of the connecting shaft 22 and the proximal end of the toe 24 are configured with interdigitated profiles 27. Examples of such interdigitated profiles are shown in FIGS. 1, 2A, 2B, 3, 4A, and 4B. In a further embodiment, the interdigitated profiles 27 are sufficiently interposed that when the central shaft 20 is turned, the connecting shaft and toe remain interdigitated. Stated otherwise, the interdigitated profiles are sufficiently interlocking to prevent the connecting shaft and the toe from slipping apart or coming out of place during the screwing process. There are numerous interdigitated profile arrangements that could be utilized with the embodiments of the subject invention. Examples of interdigitated profiles include interlocking rectangular teeth, triangular teeth, trapezoidal teeth, or other shapes that allow the connecting shaft to move axially away from the toe for at least a certain distance.

However, as mentioned above, the bi-directional assembly 50 can be positioned between the connecting shaft and the toe and fixedly attached thereto. In an embodiment, the connecting shaft and toe remain aligned with minimal, or no, tolerance therebetween, to prevent the center assembly from experiencing damaging torque forces during turning. In an embodiment, the interdigitated profiles have a deep enough interposition to ensure the operable connection between the connecting shaft and the toe, even in the absence or reduction of axial force.

In a particular embodiment, the interdigitated profiles of the connecting shaft and the toe are composed of one or more closely interlocking teeth 27, an example of which is shown in FIGS. 2A-B, and 4A-B. In this embodiment, the interlocking teeth allow each component to be turned simultaneously, such that when the connecting shaft 22 is turned, the toe 24 is likewise turned. The number and spacing or positioning of the interlocking teeth can vary depending upon the dimensions of the connecting shaft and toe, particularly the diameters thereof, the material of the connecting shaft and toe, the amount of torque expected to be applied during the screwing process, as well as a diversity of other factors that are known to those with skill in the art. In a further particular embodiment, two or more alternating and interlocking teeth are equally spaced on each of the connecting shaft and the toe, as shown, for example, in FIGS. 2A-B and 4A-B. In an embodiment, the teeth can be paired such that the teeth of each pair are positioned symmetrically to each other with respect to the longitudinal axis of the connecting shaft and toe, respectively. In a preferred embodiment, the longitudinal axis of the connecting shaft is collinear with the longitudinal axis of the toe. This can ensure that the moment of force is directed towards the center of the shaft and can further reduce or prevent undesirable bending or turning of the central shaft 20.

In a specific embodiment, an example of which is illustrated in FIGS. 2A-B, and 4A-B, the connecting shaft 22 and the toe 24 each include four interlocking teeth, such that the four teeth of the connecting shaft 22 interdigitate with the four teeth on the toe 24. In a further specific embodiment, the teeth are equidistantly spaced around the circumference of the distal end of the connecting shaft and the circumference of the proximal end of the toe. The equal spacing of the teeth can facilitate equal, or approximately equal, distribution of the torque or turning force applied during the screwing process.

Figure 9:
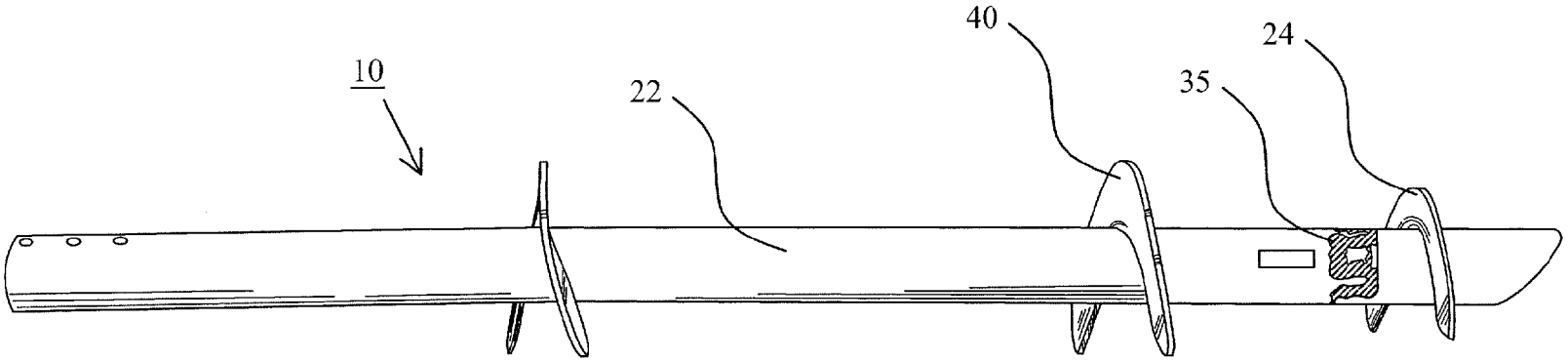
FIG. 9 is a photograph of an assembled helical pile according to one embodiment of the subject invention. Note the tack welding near the distal end that connects the toe section to the connecting shaft.

Because the location of the bi-directional assembly 50 can be between the connecting shaft and toe, it can be important for the connecting shaft and the toe sections to remain operably connected, even in the absence of the application of axial force. This can prevent the bi-directional assembly 50 therein from supporting the weight of either the toe or connecting shaft, which could have a detrimental effect on the bi-directional assembly. Further, during the initial installation, the pile, such as a helical pier, is typically positioned vertically or at an angle that would cause the toe section to separate from the connecting shaft prior to the toe being supported by the soil, if it were not somehow affixed thereto. Such operable connection can be maintained by the use of any of a variety of temporary attachment devices or methods, such as, for example, adhesives, welds, break away collars or tabs, or other known temporary or breakable attachment procedures or materials. Preferably, such temporary attachment can be broken or otherwise detached to allow separation of the connecting shaft and the toe upon application of sufficient separation force between the connecting shaft and the toe. In a specific embodiment, one or more temporary tack welds 35 are used to attach the connecting shaft and the toe, an example of which can be seen in FIG. 9. It would be well within the skill of a person trained in the art, having benefit of the subject disclosure, to devise any of a variety of alternative methods and/or devices for temporarily attaching the connecting shaft and toe. Such variations are contemplated to be within the scope of the subject invention.

To assist with the screwing process and the stability of a helical pile, one or more helical plates 40 are typically employed and fixedly attached to the central shaft. Helical plates are well-known to those with skill in the art and are, in general, an elongated plate attached in a thread-like manner to the periphery of the central shaft. The representation would be similar to the threads on a common wood screw. Ideally, the configuration of the helical plates allows them to act in displacing soil rather than excavating it. There are several advantages to this method, including the lack of spoil that must be removed from the site and the chance of contacting contaminated soils.

The helical plates can be fixedly attached at any point along the length of the central shaft, but are usually located closer to the distal end than the proximal end. Certain embodiments of the subject invention utilize a single helical plate fixedly attached to the toe section 24, for example, as shown in FIGS. 1 and 2B. Alternative embodiments utilize multiple helical plates fixedly attached to the toe section, as well as the connecting shaft 22, as shown, for example, in FIGS. 3 and 4A-4B. Still other alternative embodiments utilize helical plates fixedly attached only to the connecting shaft. The factors that can be considered by those skilled in the art with regard to the choice of materials for each of the components of the central shalt have been discussed above and are reasserted here with regard to helical plates. In a particular embodiment, a helical plate comprises galvanized steel. In a specific embodiment, a helical plate conforms to the CSA G40.20/G40.21-04 standard for structural quality rolled steel.

Once a helical pile has been installed, the static load bearing capacity of the pile can be determined before committing to construction upon the pile system. Embodiments of the subject invention advantageously employ a bi-directional assembly 50 to predict the capacity of a helical pile. Referring to FIG. 5A, an embodiment of the bi-directional assembly 50 of the subject invention includes a center assembly 60 operatively engaged with a top bearing 52 and a bottom bearing 56 that when assembled form an adjustable chamber 80, therein, that can contain a bi-directional testing apparatus (not shown). In one embodiment, the bi-directional testing apparatus is a hydraulically-driven, high capacity, sacrificial pressure cell. In use, pressure loading is applied in two equal, opposite directions. The pressure loading is applied upward, causing an upward force on the connecting shaft, and applied downward, causing a downward force on the toe. In specific embodiments the upward force on the connecting shaft can be caused by the pressure cell pushing on the top bearing, while the top bearing is attached to the connecting shaft, or in contact with the connecting shaft such that the top bearing is prevented from moving upward with respect to the connecting shaft, or by the pressure cell pushing directly on the connecting shaft. Likewise, in specific embodiments, the downward force on the toe can be caused by the pressure cell pushing down on the bottom bearing, while the bottom bearing is attached to the tow or in contact with the toe such that the bottom bearing is prevented from moving downward with respect to the toe, or by the pressure cell pushing downward on the toe. The force applied upwards against the top bearing 52 can test, for example, side shear of the connecting shaft, and the force downward against the bottom bearing 56 can test, for example, soil resistance on the toe section. In a specific embodiment, the bi-directional testing apparatus is an Osterberg Cell®, also known as an O-Cell®. O-Cell® apparatuses are well-known in the art and are used routinely to test static load capacity of a myriad of poured, driven, or drilled piles. The embodiments of the subject invention provide the unique advantage of being able to utilize O-Cell® technology with helical pile apparatuses.

In accordance with embodiments of the invention, the center assembly 60 is, in general, an elongated, hollow pipe or similar tubular structure. The length of the center assembly can vary, but should be sufficiently long enough that only the wall 61 of the center assembly is exposed during testing and ends of the center assembly remain within the central shaft 20. In a particular embodiment, the length of the center assembly is between 18.0 inches and 19.0 inches. In a specific embodiment, the center assembly is approximately 18.75 inches in length. During installation and testing of a helical pile, the entire bi-directional assembly 50 can be positioned within the central shaft 20. Therefore, the center assembly can have a smaller diameter than the connecting shaft section(s) and/or toe sections, allowing it to fit within and between at least two sections during operation. In a particular embodiment, the diameter of the center assembly 60 is such that, with minimal tolerance, it can be positioned within and between the connecting shaft 22 and toe 24 sections. With minimal tolerance between the internal center assembly the external connecting shaft and toe sections can engender alignment of the interlocking teeth 26 on the connecting shaft and toe sections and can further ensure that the center assembly 60 experiences little or none of the torque forces applied during the screwing process.

In further accordance with embodiments of the subject invention, the distal and proximal ends of the wall 61 of the center assembly 60 are cooperatively engaged with the top bearing 52 and the bottom bearing 56, such that they can moveably or adjustably interact. In an embodiment such interaction is in a piston-like fashion. This moveability or adjustability between components accommodates expansion of the internal O-cell®, which occurs during the testing process. This adjustable cooperative engagement between these bi-directional assembly 50 components can be accomplished by any number of devices, configurations, and/or methods known to those with skill in the art. Such variations, that are not inconsistent with the teachings herein, are contemplated to be within the scope of the embodiments of the present invention.

In a particular embodiment, the distal end and proximal end of the wall 61 of the center assembly 60 are configured with one or more flanges 62. The flanges can extend parallel to the center assembly. In a more specific embodiment, the flanges extend collinearly therefrom. In a specific embodiment, the distal end and proximal end of wall 61 of the center assembly 60 are configured with four flanges extending collinearly therefrom. FIGS. 5A-5B and 8A-8B illustrate an example of this embodiment. In a further embodiment, the flanges 62 are configured to slidably engage within corresponding bearing notches 58, discussed below, within the top bearing 52 and bottom bearing 56. This can permit axial motion, i.e., proximal end to distal end motion, between the bearings and the center assembly, but limits rotational motion. Further, as similarly discussed above with regard to the connecting shaft and toe components, it can be preferable for the center assembly flanges 62 and the corresponding top and bottom bearings notches 58 to cooperatively engage with minimal tolerance therebetween. This can reduce or prevent undesirable torque forces on the components and/or twisting of the internal O-cell®. Precise tolerances can further assist with guiding and maintaining alignment of the interdigitating profiles 27 between the external connecting shaft 22 and the toe 24.

The flanges 62 can be of variable length, or individual flanges may be of different lengths. However, it can be particularly beneficial if the flange length(s) is equal to or exceeds the expected maximum distance of expansion of the internal O-cell®. This can prevent the center assembly from becoming disengaged from the top and bottom bearings during testing of the helical pier. In a particular embodiment, the length of the one or more flanges 62 is approximately one half the length of the center assembly. In a specific embodiment, the length of the one or more flanges is between 9.0 inches and 9.5 inches. In a more specific embodiment, the length of the one or more flanges is approximately 9.375 inches.

Figure 10:
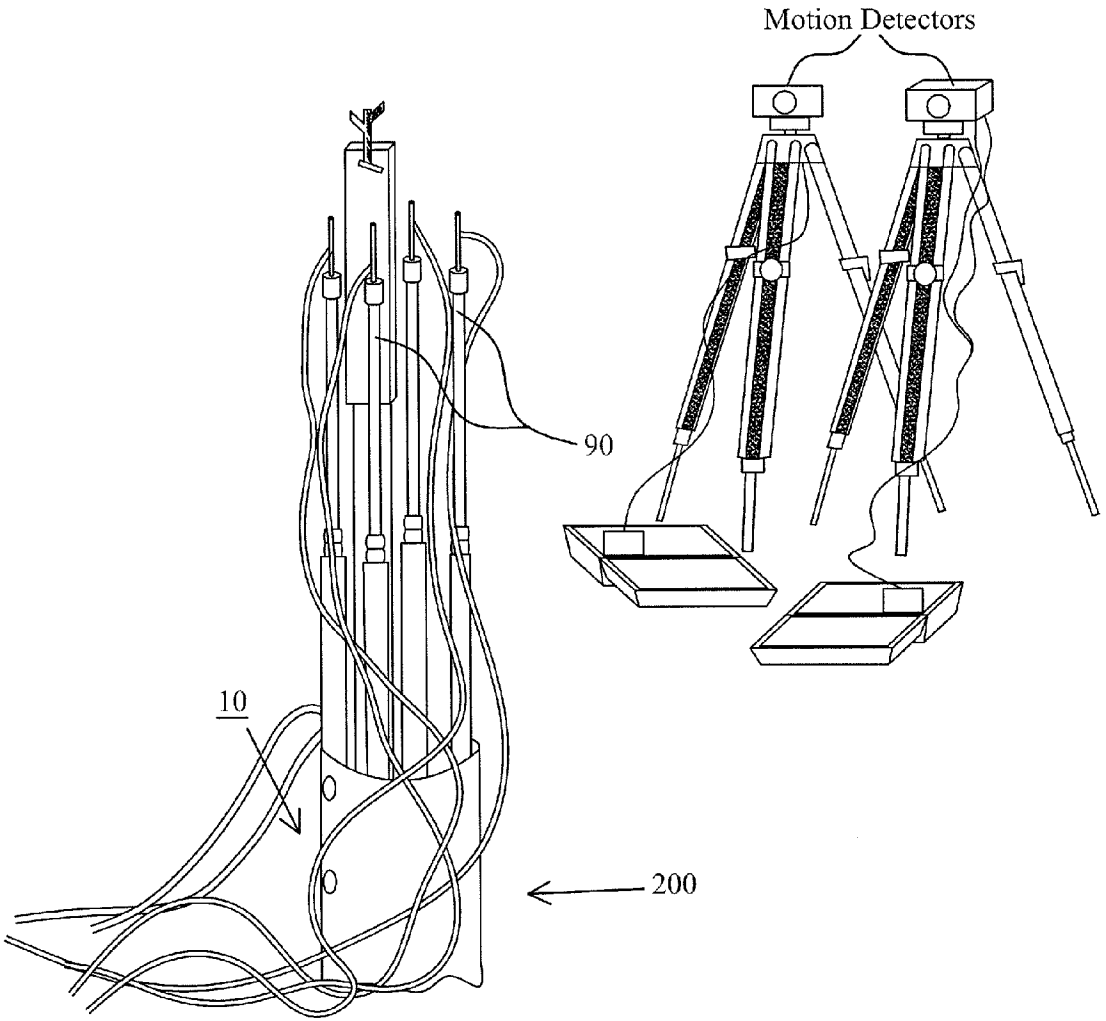
FIG. 10 is a photograph of the proximal end of a helical pile installed within a soil profile. Note the motion detection devices on tripods in the background that are directed towards the tell tale rods extending from the peripheral end of the central shaft.

During testing of a helical pile, one or more tell tale rods 90 can be utilized to detect changes in the position of the toe and/or connecting shaft. FIG. 10 shows a picture of a helical pile that has been rotated into the soil, with tell tale rods 90 extending from the proximal end of the helical pile. Typically, one or more tell tale rods 90 are passed through the proximal end opening 28 of the central shaft 20, such that one end of the tell tale rods 90 remains visible above the proximal end opening 28, as shown, for example, in FIG. 10, and the opposite end is attached to either the top bearing 52 or the bottom bearing 56, so as to detect motion of one or both of those components. FIG. 10 illustrates an example of an installed helical pile, according to the subject invention, with at least four tell tale rods 90 extending about the proximal end of the central shaft 20. Movement of the top bearing and/or bottom bearing can be correlated to movement of the connecting shaft or toe, respectively. The amount of force exerted by the O-cell® to move these bearings can be used to determine the overall static load bearing capacity of the helical pile and/or other characteristics of the installed helical pile.

In an embodiment, to facilitate attachment to the bottom bearing 56, the tell tale rods 90 can bypass or pass through the top bearing 52 and the center assembly 60. In one embodiment, the top bearing 52 can include one or more openings, slots, notches, or other orifice to allow passage of one or more tell tale rods through the adjustable chamber 80. In a further embodiment, the top bearing can include one or more access holes 53 through which the bi-directional apparatus can be accessed during the testing process.

Figure 8B:
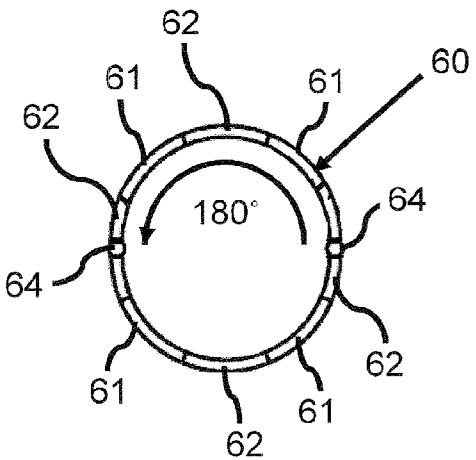
FIGS. 8A and 8B illustrate a top view (FIG. 8B) and a side cut-away view (FIG. 8A) of an embodiment of a center assembly.
Figure 8A:
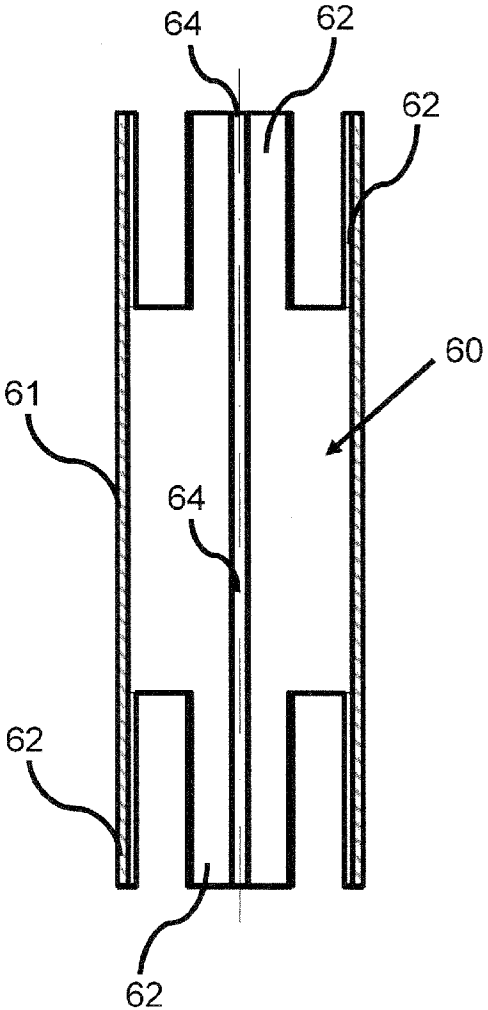

Alternatively, the center assembly can include one or more passages that accommodate the tell tale rod. In a particular embodiment, the center assembly is configured with one or more ducts 64 therethrough that provide passage of the tell tale rods to the bottom bearing. In a particular embodiment, at least one duct 64 is formed through the wall 61 of the center assembly. In another particular embodiment, at least one duct 64 is formed through the wall 61 and flanges 62 of the center assembly. In a specific embodiment, two ducts 64 are formed through opposite sides of the wall 61 and flanges 62 of the center assembly, an example of which is shown in FIGS. 8A and 8B. In this embodiment, each duct 64 extends through a flange 62 on the proximal end of the center assembly, so as to bypass the upper bearing. The ducts then extend through the wall 61 of the center assembly to open at the distal end of the center assembly. In one embodiment the duct extends through a flange 62 at the distal end of the center assembly to open at the most distal end of the flange, as seen, by way of example, in FIG. 8A. Thus, in this embodiment, the proximal and distal end flanges 62 are aligned, or at least partially aligned, so as to permit passage of a duct therethrough. In an alternative embodiment, at least one duct extends through the wall of the center assembly between the one or more flanges. Once the tell tale rod has been passed through the center assembly, it can be fixedly attached to the bottom bearing, toe section, or other structure to secure it for testing.

The duct can have any of a variety of configurations that can accommodate a tell tale rod. Thus, a duct can be a completely closed passage or may include one or more openings along its length. In a specific embodiment, the duct is collinear with the center assembly, as seen, for example in FIG. 8A. But, if necessary, the duct can be non-collinear with the center assembly. The diameter of a duct can also vary depending upon the dimensions of the tell tale rod to be used therein. In a particular embodiment, a duct is between 0.5 inch and 1.0 inch in diameter. In a specific embodiment a duct is approximately 0.75 inches in diameter.

In a specific embodiment of the invention, a duct is formed by use of one or more pipes, tubes, or other elongated tubular-type piece. In this embodiment, the center assembly is longitudinally divided, i.e., from the proximal end to the distal end, into two semi-circular sections, such that each section comprises approximately one-half or 180° of the circumference of the center assembly. In an alternative embodiment, the center assembly is longitudinally divided into two sections, wherein one section is greater than 180° of the circumference. In another alternative embodiment, the center assembly is divided into more than two sections. In a further specific embodiment, a duct 64 is formed by use of one or more pipes, tubes, or other elongated cylindrical-type piece fixedly attached between each section of the center assembly, so as to be collinear with the line(s) of division. Thus, the center assembly can have two or more sections wherein the wall 61 is joined together around two or more pipes to form ducts 64 therebetween. FIG. 8B demonstrates an example of this embodiment. The diameter of the pipe can be greater than, less than, or equivalent to the thickness of the wall 61.

In a further embodiment, the top bearing 52 and the bottom bearing 56, mentioned previously, are utilized at the proximal end and distal end of the wall 61 of the center assembly 60, respectively. The bearings can be any of a variety of devices or apparatuses capable of traversing across and being directly or indirectly fixedly attached to the interior walls 29 of the central shaft. In a specific embodiment, the top bearing 52 and bottom bearing 56 can be integral with the distal end of the connecting shaft and the proximal end of the toe, respectively. In one embodiment, the bearings are one or more rods, struts, trusses, or other like devices arranged to form a support and/or guide for the center assembly. In an alternative embodiment, the bearings are plates, panels, disks, or other similar flat or semi-flat devices that traverse across and are fixedly attached to the interior walls 29 of the central shaft. FIGS. 6A-B and 7A-B illustrate examples of a top bearing and a bottom bearing, respectively, in the form of flat disks that can be fixedly attached to the interior walls 29 of the central shaft. A person with skill in the art would be able to determine any of a variety of shapes or configurations suitable for use as a bearing with the subject invention. Such variations are considered to be within the scope of the subject invention.

Figure 6A:
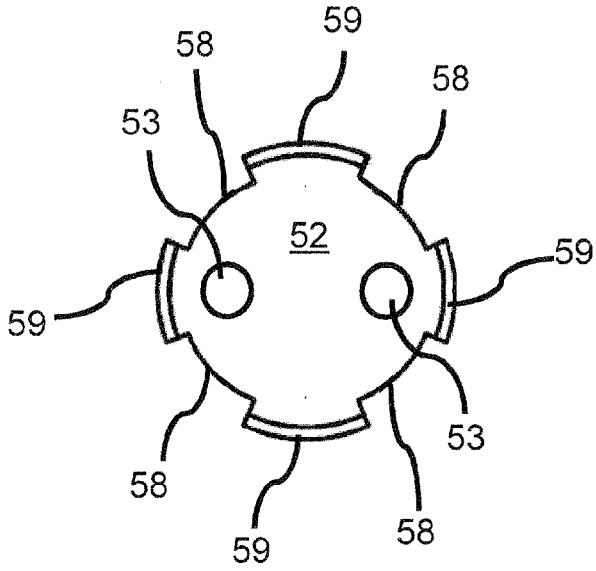
FIGS. 6A and 6B illustrate a top view and side cut-away view, respectively, of an embodiment of an upper bearing having four guides equally distributed around the periphery of the bearing.
Figure 6B:
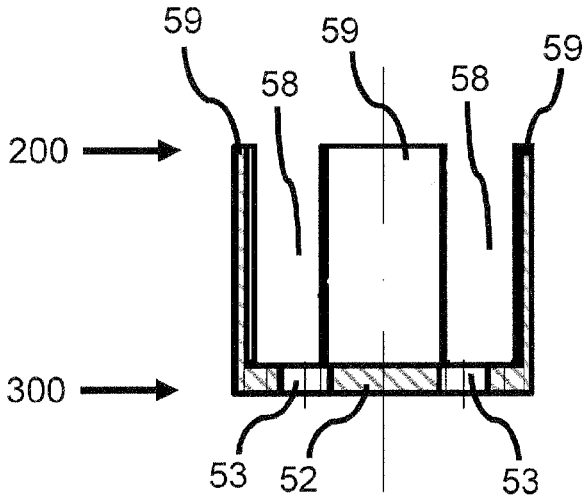
Figure 7B:
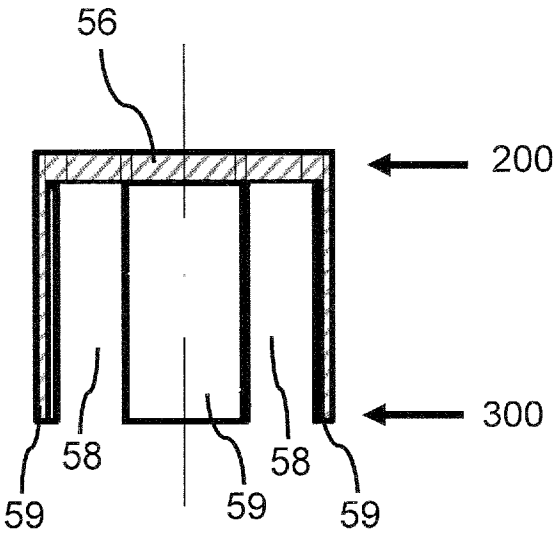
FIGS. 7A and 7B illustrate a top view and side cut-away view, respectively, of an embodiment of a bottom bearing having four guides equally distributed around the periphery of the bearing.
Figure 7A:
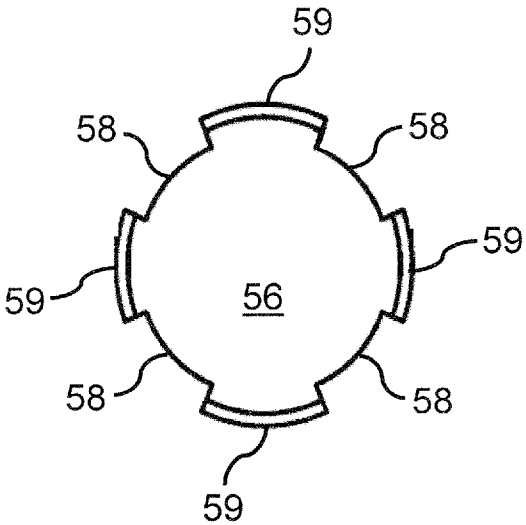

In general, the bearings can act as supports and/or guides for the center assembly. In one embodiment, the bearings are configured with one or more openings, such as holes, slits, notches, or other orifices that allow the flanges 62 of the center assembly to slidably move proximally and/or distally relative to the bearings during expansion of the O-cell®. In a particular embodiment, an example of which is shown in FIGS. 6A and 7A, one or more bearing notches 58, corresponding to the position(s) of the flange(s) 62, are formed around the periphery of the top bearing and bottom bearing. The flanges 62 on the center assembly can slidably fit within the notches allowing the top and bottom bearings to be cooperatively engaged with the center assembly and still allow it to move proximally or distally relative to the center assembly.

In a specific embodiment, the bearings are fixedly attached to the interior wall 29 of the central shaft such that, when coupled with the center assembly, the interdigitated profile 27 encircles the center assembly. Thus, the top bearing 52 can be positioned proximal to the interdigitated profile 27 and the bottom bearing 56 can be positioned distal to the interdigitated profile 27. In a specific embodiment, the top bearing 52 is fixedly attached to the connecting shaft 22 and the bottom bearing 56 is fixedly attached to the toe 24. In a further embodiment, the locations of the fixedly attached bearings are such that when the components of the central shaft 20 are assembled, e.g., when the toe 24 is detachably connected to the connecting shaft 22, the proximal end of the center assembly wall 61 is adjacent to the top bearing and the distal end of the center assembly wall 61 is adjacent to the bottom bearing. In this embodiment, the flanges 62 at each end of the center assembly wall will extend through the bearing notches 58, for example, as shown in FIG. 5B.

The attachment of the top bearing and bottom bearing to the interior wall 29 of the central shaft 20 can be accomplished by any means known to those with skill in the art. In one embodiment, the bearings are welded to the interior wall. In a further embodiment, one or more plug weld holes 37 are configured within the wall of the connecting shaft 22 and/or the wall of the toe 24. The plug weld holes 37 can be utilized to secure the top bearing within the connecting shaft and the bottom bearing within the toe. In a specific embodiment, the bearings are welded through the plug weld holes 37 to the connecting shaft and/or toe sections.

As detailed above, the top bearing and bottom bearing can be cooperatively engaged with the center assembly. The engagement of these components forms an adjustable chamber 80 within the center assembly in which the bi-directional assembly 50 can be secured. FIGS. 1 and 3 illustrate one embodiment of an adjustable chamber created by the components of the bi-directional assembly. Thus, the top bearing and bottom bearing are used to define the proximal end and distal end, respectively, of the chamber 80. This can permit the bearings to be disposed against the proximal and distal ends, respectively, of the center assembly. This can assure that the positions of the top and bottom bearings are fixed prior to testing, so that any movement thereof is attributable to expansion of the O-cell®.

In a further embodiment, the top and/or bottom bearing can include one or more bearing guides 59 fixedly attached thereto. The bearing guides 59 can be used to further support and direct the movements of the flanges. In one embodiment, bearing guides are elongated structures attached to the proximal side of the top bearing and the distal end of the bottom bearing. In a further embodiment, the bearing guides are attached adjacent to the bearing notches. In a specific embodiment, the flanges 62, which are positioned within the bearing notches 58 are further slidably engaged with the bearing guides 59. FIGS. 6A-B and 7A-B illustrate this embodiment of a top and bottom bearing. In a more specific embodiment, the bearing guides are affixed to the proximal side of the top bearing, such that when installed they are substantially parallel with and in close proximity to, or in contact with, the interior wall 61 of the central shaft 20. FIGS. 5A-B illustrate one example of this embodiment. This configuration of the bearing notches 58 and bearing guides 59, in conjunction with the interior wall 29, can provide the flanges with sufficient support and guidance to ensure accurate operation of the O-cell® after the helical pier is installed within a soil profile.

Figure 11A:
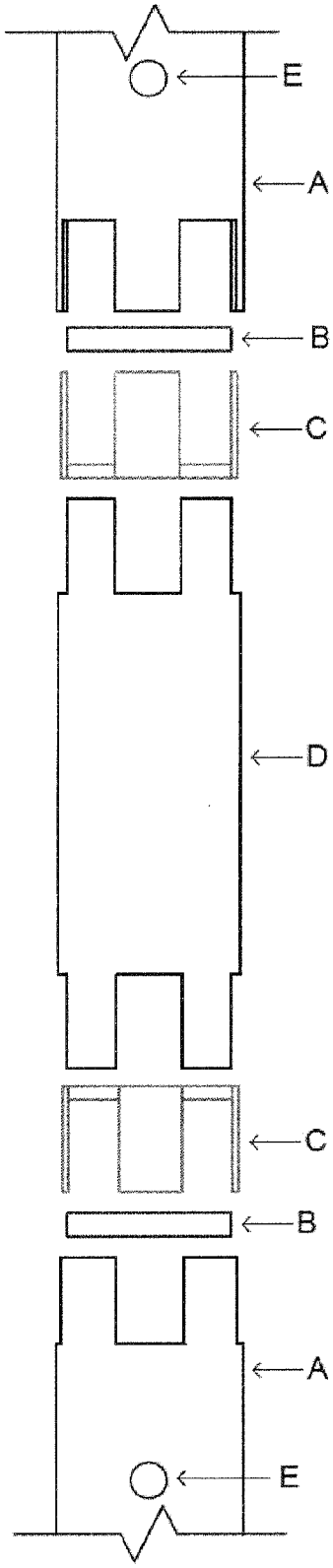
FIGS. 11A and 11B show an embodiment of a bi-directional assembly in accordance with the subject invention, where
Figure 11B:
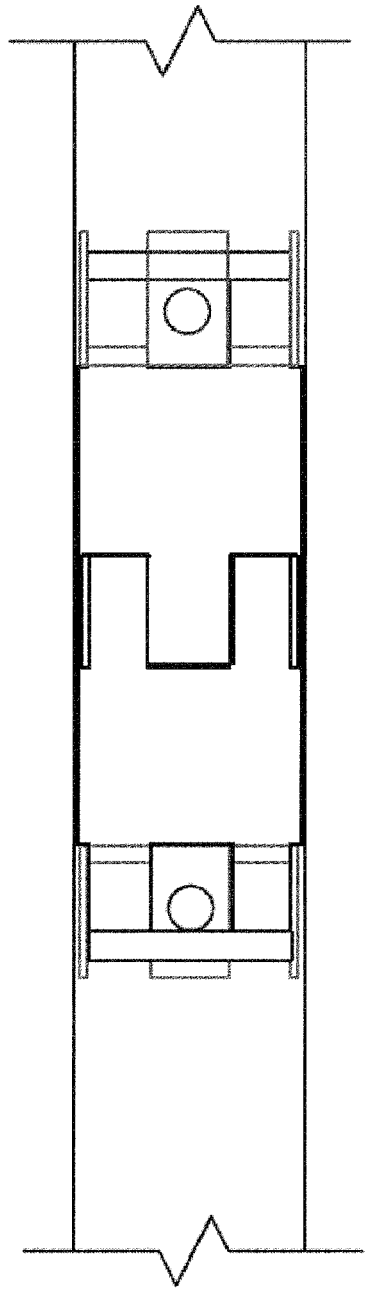

FIGS. 11A and 11B show a specific embodiment of the subject pile with a bi-directional assembly, where FIG. 11A shows an exploded view and FIG. 11B shows a view after assembly. This embodiment is similar to the embodiment shown in FIGS. 5A and 5B, and further includes two lock plates B. An O-cell, or other force applying apparatus, is inserted into the drive gear D, or center assembly, and the O-cell is sandwiched between the two connection push plates C, or top bearing and bottom bearing. The two lock plates B are inserted and positioned flush with the top of the tabs, or flanges 62, on the drive gear D, or center assembly 60, and welded in place. Typically, the lock plates B are welded in place on both sides. The entire gear mechanism, or bi-directional assembly, is then inserted into the pipe A. The push plates C, or top bearing 52 and lower bearing 56, can then be plug welded via plug weld holes E, or 37. The two sections of pipe can then be tack welded together.

Following are examples that illustrate procedures for practicing certain embodiments of the subject invention. These examples are provided for the purpose of illustration only and should not be construed as limiting. Thus, any and all variations that become evident as a result of the teachings herein or from the following examples are contemplated to be within the scope of the present invention.

Example 1

Helical Pier with Bi-Directional Testing Apparatus

A helical pier system with bi-directional testing capabilities, according to the embodiments of the subject invention, utilizes components that are assembled prior to installation within a soil profile. Initially, the central shaft is divided into a connecting shaft and a toe section having four interlocking teeth forming a stable interdigitating. A first helical plate is attached to the connecting shaft and a second helical plate is attached to the toe. Additional helical plates can be attached if desired.

The top bearing and bottom bearing can next be installed within the connecting shaft and toes sections, respectively. However, prior to installation of the top bearing, a O-cell® is welded to the top bearing on the side opposite the bearing guides. The top bearing and bottom bearing can then be fixedly installed by tack welding to the interior wall through one or more plug weld holes. Each bearing is configured with four bearing notches and four corresponding bearing guides. The bearing notches and bearing guides on the top bearing are aligned with the bearing notches and bearing guides on the bottom bearing. During installation of the bearings, the bearing guides of the top bearing are directed proximally and the bearing guides on the bottom bearing are directed distally. The positions of the bearings within the connecting shaft and toe are dependent upon the length of the central assembly to be used. Ideally, the bearings should be positioned adjacent to the proximal and distal ends of the central assembly wall when the bi-directional assembly is put together.

The center assembly is a section of pipe of pre-determined length and diameter to slidably fit within the central shaft and operably connect with the bearings. The distal end and proximal end of the center assembly wall are further manufactured with four flanges positioned so as to be operably connected to the bearing notches and bearing guides on the bearings. The center assembly is bifurcated from the most proximal to the most distal end, including through at least two flanges on the top bearing and at least two similarly aligned flanges on the bottom bearing. The bifurcated center assembly can be re-welded to a 0.75 inch diameter pipe positioned parallel to the line of bifurcation to form a duct through the flanges and the wall.

Next, four tell tale rods can be inserted through the proximal end of the central shaft. Two of the tell tale rods will be connected to the top bearing by welding or other permanent method. The two other tell tale rods are threaded through the duct towards the opening on the flange(s) on the distal end of the center assembly. These tell tale rods can also be connected to the bottom bearing by welding or other permanent method. At this point the toe section, with the fixedly attached bottom bearing, can be placed against the distal end of the connected shaft. During this procedure the notches of the bottom bearing can be aligned with flanges on the distal end of the central assembly and the interlocking teeth of the connecting shaft and toe can also be aligned.

Once the components of the bi-directional assembly are fitted together, the connecting shaft and toe sections can be tack welded to maintain the position of the assembly components during installation.

The disclosure herein describes embodiments of the subject invention particularly useful in the field of deep foundation systems and engineering and, in particular, methods and devices for placement and bi-directional testing of helical piles. However, a person with skill in the art will be able to recognize numerous other uses that would be applicable to the devices and methods of embodiments of the subject invention. While the subject application describes methods and devices for use with a helical pile, or screw pile, other modifications apparent to a person with skill in the art and having benefit of the subject disclosure are contemplated to be within the scope of the present invention.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

It should be understood that any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. Further, when a particular feature, structure, or characteristic is described in connection with any embodiment, it is submitted that it is within the purview of one skilled in the art to affect such feature, structure, or characteristic in connection with other ones of the embodiments.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modifications, both as to equipment details and operating procedures can be effected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

We claim:

1. A pile assembly, comprising:

a connecting shaft section;

a toe shaft section;

a bi-directional assembly, wherein the bi-directional assembly interconnects with the connecting shaft section and the toe shaft section such that as the connecting shaft section is rotated in a driving direction about a pile longitudinal axis the toe shaft section is also rotated in the driving direction about the pile longitudinal axis, wherein the bi-directional assembly is adapted to simultaneously apply a separation force to the toe shaft section tending to push the toe shaft section away from the connecting shaft section and apply the separation force to the connecting shaft section tending to push the connecting shaft section away from the toe shaft section; and at least one extension structure, wherein each extension structure is attached to the connecting shaft section and/ or to the toe shaft section, wherein when the connecting shaft section is rotated in a driving direction about the pile longitudinal axis and the toe shaft section is rotated in the driving direction about the pile longitudinal axis, while one or more of the at least one extension structure is positioned in a ground medium, the ground medium applies a driving force to the one or more of the at least one extension structure such that the driving force tends to push the pile assembly further into the ground medium.

2. The pile assembly according to claim 1, wherein the bi-directional assembly comprises:

a connecting plate; and a toe plate, wherein the connecting plate applies the separation force to the connecting shaft section and the toe plate applies the separation force to the toe shaft section, wherein the pile assembly further comprises:

a force detector, wherein the force detector detects the separation force;

a separation detector, wherein the separation detector detects a change in separation distance between the connecting plate and the toe plate;

a connecting displacement detector, wherein the connecting displacement detector detects a displacement distance of the connecting shaft section along the pile longitudinal axis; and a toe displacement detector, wherein the toe displacement detector detects a displacement distance of the toe shaft section along the pile longitudinal axis.

3. The pile assembly according to claim 2, wherein after the pile is positioned in a ground medium having a surface level such that the toe shaft section is below the surface level and at least a portion of the connecting shaft section is below the surface level, the separation force, the change in separation distance between the connecting plate and the toe plate, the displacement distance of the connecting shaft section, and the displacement distance of the toe shaft section provide information regarding the load capacity of the pile assembly in the ground medium.

4. The pile assembly according to claim 1, wherein the at least one extension structure is at least one helical plate.

5. The pile assembly according to claim 1, wherein the driving direction is clockwise.

6. The pile assembly according to claim 1, wherein the connecting shaft section comprises:

one or more connecting profiles extending from a distal end of the connecting shaft section, wherein the toe shaft section comprises:

one or more toe profiles extending from a proximal end of the toe shaft section, wherein the one or more connecting profiles interdigitate with the one or more toe profiles such that rotating the connecting shaft section about the pile longitudinal axis in a driving direction rotates the toe shaft section about the pile longitudinal axis in the driving direction via the one or more connecting profiles pushing on the one or more toe profiles so as to provide a torque to the toe shaft section about the pile longitudinal axis.

7. The pile assembly according to claim 1, wherein a distal end of the connecting shaft section comprises a connecting hollow portion for receiving a proximal portion of the bi-directional assembly, wherein a proximal end of the toe shaft section comprises a toe hollow portion for receiving a distal portion of the bidirectional assembly.

8. The pile assembly according to claim 7, wherein the bi-directional assembly comprises:

a connecting bearing, wherein the connecting bearing is attached inside the connecting hollow portion;

a toe bearing, wherein the toe bearing is attached inside the toe hollow portion;

a central assembly, wherein a proximal end of the central assembly is positioned within the connecting hollow portion, wherein a distal end of the central assembly is positioned within the toe hollow portion; and a separation cell, wherein the separation cell comprises a connecting plate and a toe plate, wherein the separation cell is positioned within the central assembly, wherein the separation cell applies the separation force to the connecting shaft section via the connecting plate, and the separation cell applies the separation force to the toe shaft section via the toe plate.

9. The pile assembly according to claim 8, wherein the separation cell applies the separation force to the connecting shaft section and to the toe shaft section by application of a pressurized fluid between the connecting plate and the toe plate.

10. The pile assembly according to claim 9, wherein the pressurized fluid is a pressurized hydraulic fluid.

11. The pile assembly according to claim 1, wherein the connecting shaft section and the toe shaft section are temporarily attached such that relative movement between the connecting shaft section and the toe shaft section is prevented, wherein when the bidirectional assembly applies a threshold separation force to the toe shaft section and the connecting shaft section, the temporary attachment is ended such that the toe shaft section and the connecting shaft section can move away from each other along the pile longitudinal axis.

12. The pile assembly according to claim 8, wherein the proximal end of the central assembly comprises one or more proximal flanges that slidably interconnect with the connecting bearing such that the connecting bearing prevents relative rotational motion between the proximal end of the central assembly and the distal end of the connecting shaft section about the pile longitudinal axis, and allows relative axial movement between the connecting shaft section and the central assembly in a direction parallel to the pile longitudinal axis, wherein the distal end of the central assembly comprises one or more distal flanges that slidably interconnect with the toe bearing such that the toe bearing prevents relative rotational motion between the distal end of the central assembly and the proximal end of the toe shaft section about the pile longitudinal axis, and allows relative axial movement between the toe shaft section and the central assembly in a direction parallel to the pile longitudinal axis.

13. The pile assembly according to claim 12, wherein the central assembly further comprises:

a connecting locking plate; and a toe locking plate, wherein the connecting locking plate is attached to at least one proximal end of the one or more proximal flanges, wherein the connecting locking plate prevents the proximal end of the central assembly from separating from the connecting bearing, wherein the toe locking plate is attached to at least one distal end of the one or more distal flanges, wherein the toe locking plate prevents the distal end of the central assembly from separating from the toe bearing.

14. The pile assembly according to claim 2, wherein the bi-directional assembly applies the separation force to the connecting shaft section and to the toe shaft section by application of a pressurized fluid between the connecting plate and the toe plate, wherein the force detector detects the connecting force by measuring a pressure of the pressurized fluid.

15. The pile assembly according to claim 2, wherein the connecting displacement detector comprises a connecting tell tale rod, wherein the toe displacement detector comprises a toe tell tale rod.

16. The pile assembly according to claim 12, wherein the connecting bearing comprises a corresponding one or more connecting notches, wherein the corresponding one or more proximal flanges slidably interconnect with the connecting bearing via the one or more proximal flanges sliding in the corresponding one or more connecting notches, wherein the toe bearing comprises a corresponding one or more toe notches, wherein the corresponding one or more distal flanges slidably interconnect with the toe bearing via the one or more distal flanges sliding in the corresponding one or more toe notches.

17. The pile assembly according to claim 1, wherein the bi-directional assembly comprises:

a connecting plate; and a toe plate, wherein the connecting plate applies the separation force to the connecting shaft section and the toe plate applies the separation force to the toe shaft section, wherein the pile assembly further comprises:

a force detector, wherein the force detector detects the separation force;

a separation detector, wherein the separation detector detects a change in separation distance between the connecting plate and the toe plate;

a connecting displacement detector, wherein the connecting displacement detector detects a displacement distance of the connecting shaft section along the pile longitudinal axis; and a toe displacement detector, wherein the toe displacement detector detects a displacement distance of the toe shaft section along the pile longitudinal axis, wherein the connecting shaft section comprises:

one or more connecting profiles extending from a distal end of the connecting shaft section, wherein the toe shaft section comprises:

one or more toe profiles extending from a proximal end of the toe shaft section, wherein the one or more connecting profiles interdigitate with the one or more toe profiles such that rotating the connecting shaft section about the pile longitudinal axis in a driving direction rotates the toe shaft section about the pile longitudinal axis in the driving direction via the one or more connecting profiles pushing on the one or more toe profiles so as to provide a torque to the toe shaft section about the pile longitudinal axis, wherein a distal end of the connecting shaft section comprises a connecting hollow portion for receiving a proximal portion of the bi-directional assembly, wherein a proximal end of the toe shaft section comprises a toe hollow portion for receiving a distal portion of the bidirectional assembly, wherein the bi-directional assembly comprises:

a connecting bearing, wherein the connecting bearing is attached inside the connecting hollow portion;

a toe bearing, wherein the toe bearing is attached inside the toe hollow portion;

a central assembly, wherein a proximal end of the central assembly is positioned within the connecting hollow portion, wherein a distal end of the central assembly is positioned within the toe hollow portion; and a separation cell, wherein the separation cell comprises the connecting plate and the toe plate, wherein the separation cell is positioned within the central assembly, wherein the separation cell applies the separation force to the connecting shaft section via the connecting plate, and the separation cell applies the separation force to the toe shaft section via the toe plate.

18. The pile assembly according to claim 17, wherein after the pile is positioned in a ground medium having a surface level such that the toe shaft section is below the surface level and at least a portion of the connecting shaft section is below the surface level, the separation force, the change in separation distance between the connecting plate and the toe plate, the displacement distance of the connecting shaft section, and the displacement distance of the toe shaft section provide information regarding the load capacity of the pile assembly in the ground medium, wherein the bi-directional assembly applies the separation force to the connecting shaft section and to the toe shaft section by application of a pressurized fluid between the connecting plate and the toe plate, wherein the force detector detects the connecting force by measuring a pressure of the pressurized fluid.

19. The pile assembly according to claim 17, further comprising:

at least one extension structure, wherein each extension structure is attached to the connecting shaft section and/or to the toe shaft section, wherein when the connecting shaft section is rotated in a driving direction about the pile longitudinal axis and the toe shaft section is rotated in the driving direction about the pile longitudinal axis, while one or more of the at least one extension structure is positioned in a ground medium, the ground medium applies a driving force to the one or more of the at least one extension structure such that the driving force tends to push the pile assembly further into the ground medium, wherein the proximal end of the central assembly comprises one or more proximal flanges that slidably interconnect with the connecting bearing such that the connecting bearing prevents relative rotational motion between the proximal end of the central assembly and the distal end of the connecting shaft section about the pile longitudinal axis, and allows relative axial movement between the connecting shaft section and the central assembly in a direction parallel to the pile longitudinal axis, wherein the distal end of the central assembly comprises one or more distal flanges that slidably interconnect with the toe bearing such that the toe hearing prevents relative rotational motion between the distal end of the central assembly and the proximal end of the toe shaft section about the pile longitudinal axis, and allows relative axial movement between the toe shaft section and the central assembly in a direction parallel to the pile longitudinal axis.

20. The pile assembly according to claim 19, wherein the at least one extension structure is at least one helical plate, and wherein the pressurized fluid is a pressurized hydraulic fluid.

21. A method of loading testing a pile, comprising:

providing a pile assembly according to claim 2, rotating the pile assembly in a driving direction about the pile longitudinal axis into a, ground medium;

applying a first separation force;

detecting the first separation force;

detecting a first change in separation distance;

detecting a first displacement distance of the connecting shaft sections;

detecting a first displacement distance of the toe shaft sections; and determining information regarding the load capacity of the pile assembly in the ground medium.

22. A method of supporting a load, comprising:

providing a pile assembly according to claim 1, rotating the pile assembly in a driving direction about the pile longitudinal axis into a ground medium; and applying a load to the pile assembly such that the pile assembly supports the load.

23. The pile assembly according to claim 1, wherein the at least one extension structure is at least one plate.

24. The pile assembly according to claim 1, wherein one or more of the at least one extension structure is attached to the toe shaft section.

25. The pile assembly according to claim 1, wherein one or more of the at least one extension structure is attached to the connecting shaft section.

26. The pile assembly according to claim 24, wherein the at least one extension structure comprises a plurality of extension structures, wherein one or more of the plurality of extension structures is attached to the connecting shaft section.

27. The pile assembly according to claim 4, wherein the at least one helical plate is a single helical plate.

28. The pile assembly according to claim 4, wherein the at least one helical plate is a plurality of helical plates.

* * * * *